US007482898B2

(12) United States Patent
Atokawa et al.

(10) Patent No.: US 7,482,898 B2
(45) Date of Patent: Jan. 27, 2009

(54) DIELECTRIC FILTER, DIELECTRIC DUPLEXER, AND COMMUNICATION APPARATUS

(75) Inventors: Masayuki Atokawa, Ishikawa-ken (JP); Hitoshi Tada, Moriyama (JP); Takayoshi Yui, Nagaokakyo (JP); Hideyuki Kato, Moriyama (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 11/642,934

(22) Filed: Dec. 21, 2006

(65) Prior Publication Data

US 2007/0103255 A1 May 10, 2007

Related U.S. Application Data

(63) Continuation of application No. PCT/JP2005/009323, filed on May 23, 2005.

(30) Foreign Application Priority Data

Jan. 18, 2005 (JP) ..... 2005-010898

(51) Int. Cl.
*H01P 1/205* (2006.01)
*H01P 1/213* (2006.01)

(52) U.S. Cl. ..... 333/206; 333/134

(58) Field of Classification Search ..... 333/203, 333/206, 207, 222, 223
See application file for complete search history.

(56) References Cited

U.S. PATENT DOCUMENTS

| | | | | |
|---|---|---|---|---|
| 4,742,562 | A * | 5/1988 | Kommrusch | 455/78 |
| 5,150,089 | A * | 9/1992 | Komazaki et al. | 333/206 |
| 5,945,896 | A * | 8/1999 | Miyamoto | 333/206 |
| 6,340,921 | B1 * | 1/2002 | Kuroda et al. | 333/134 |
| 6,597,263 | B2 * | 7/2003 | Jun et al. | 333/202 |

FOREIGN PATENT DOCUMENTS

| | | |
|---|---|---|
| JP | 61-262301 | 11/1986 |
| JP | 62-85002 | 5/1987 |
| JP | 02-108302 | 4/1990 |
| JP | 04-211501 | 8/1992 |
| JP | 06-097721 | 4/1994 |
| JP | 10-256807 | 9/1998 |
| JP | 2001-210541 | 8/2001 |

OTHER PUBLICATIONS

International Search Report from corresponding International application dated Aug. 16, 2005.
Written Opinion from corresponding International application dated Aug. 16, 2005.

* cited by examiner

*Primary Examiner*—Seungsook Ham
(74) *Attorney, Agent, or Firm*—Dickstein, Shapiro, LLP.

(57) ABSTRACT

A dielectric filter with an ultra hetero-axial structure is provided with open end-face electrodes. By increasing the capacitance between each open end-face electrode and an external conductor greater than that generated between the open end-face electrodes adjacent to each other, the inductive coupling between two resonators due to neighboring resonator holes is increased.

32 Claims, 6 Drawing Sheets

(A)

(B)

(A)

(B)

(A)

(B)

DIELECTRIC FILTER, DIELECTRIC DUPLEXER, AND COMMUNICATION APPARATUS

CROSS REFERENCE TO RELATED APPLICATIONS

The present application is a continuation of International Application No. PCT/JP2005/009323, filed May 23, 2005, which claims priority to Japanese Patent Application No. JP2005-010898, filed, Jan. 18, 2005, the entire contents of each of these applications being incorporated herein by reference in their entirety

FIELD OF THE INVENTION

The present invention relates to a dielectric filter integrated into a dielectric block, a dielectric duplexer, and a communication apparatus having the dielectric filter and the dielectric duplexer.

BACKGROUND OF THE INVENTION

The dielectric filter and the dielectric duplexer incorporated in a high frequency circuit are always required to provide miniaturized products.

Various techniques have been provided for achieving the miniaturization. Patent document 1 describes a dielectric filter with an ultra hetero-axial structure in which the axes of a large-diameter hole section and a small-diameter hole section of a stepped resonator hole are largely shifted from each other so as to bend the resonator hole.

By arranging resonators with such resonator holes in a dielectric block, the resonators are coupled together so as to form an attenuation pole. By adjusting the pitch between the resonator holes if necessary, the attenuation pole can be tuned to a desired frequency.

A configuration example of a dielectric duplexer employing this conventional technique is shown in FIG. 1. FIG. 1 is a sectional view of the dielectric duplexer in parallel with the arranging direction of the resonator holes, in which the upper side is an open end face and the lower side is a short-circuit end face.

A dielectric block 1 is provided with a plurality of resonator holes 2A to 2C and 3A to 3C, and an inner conductor is formed on each hole. At ends of the resonator holes 2A to 2C and 3A to 3C, electrode non-forming areas 7 are provided. On the external surface of the dielectric block 1, an external conductor 6 is formed. The inner diameter of each of the resonator holes 2A to 2C and 3A to 3C adjacent to the open end face is large (this portion will be referred to as a large-diameter hole section) while the inner diameter adjacent to the short-circuit end face is small (referred to as a small-diameter hole section below) so as to form stepped holes. In this example, the distance between the resonance holes of the resonator holes 2A to 2C adjacent to the open end face is larger than that adjacent to the short-circuit end face (referred to as a cross-eyed shape below). By such a configuration, two resonators adjacent to each other are inductively coupled together due to the resonator holes 2A to 2C so as to form a transmitting filter. On the other hand, the distance between the resonance holes of the resonator holes 3A to 3C adjacent to the open end face is smaller than that adjacent to the short-circuit end face (referred to as a separate-eyed shape below). By such a configuration, two resonators adjacent to each other are capacitively coupled together due to the resonator holes 3A to 3C so as to form a receiving filter.

The attenuation pole generated by the coupling between the resonators can be adjusted by setting the eccentricity between the small-diameter hole section and the large-diameter hole section and the step ratio, which is the cross-sectional area ratio, between the small-diameter hole section and the large-diameter hole section.

When the dielectric filter and dielectric duplexer, having such an ultra hetero-axial structure, are further miniaturized, the space between the resonators is reduced in accordance with the miniaturizing, so that the wall thickness of the dielectric block is reduced. Accordingly, the capacitance between the resonators is increased. Then, the attenuation pole frequency, which is a filter characteristic, is deviated from a predetermined value, so that predetermined filter characteristics cannot be obtained.

A technique is shown in Patent Document 2 in that by providing an open end-face electrode on the open end face of the dielectric block, the resonators are coupled together. In the dielectric filter having conventional open end-face electrodes, by adjusting the shape of the open end-face electrode so as to regulate the capacitance between the open end-face electrodes, a dielectric block with desirable filter characteristics is achieved.

Patent Document 1: Japanese Unexamined Patent Application Publication No. H10-256807

Patent Document 2: Japanese Examined Patent Application Publication No. H06-097721

In the ultra hetero-axial structure mentioned above, the eccentricity between the small-diameter hole section and the large-diameter hole section cannot be established to be more than the sum of radii of the small-diameter hole section and the large-diameter hole section. Hence, the range of the obtainable eccentricity is limited. That is, when the dielectric filter and dielectric duplexer, having the conventional ultra hetero-axial structure, are further miniaturized, it has been difficult to achieve required filter characteristics even when the eccentricity is adjusted.

When the eccentricity is cross-eyed, for example, the inductive coupling falls short due to the miniaturizing, so that the desirable bandwidth may not been obtained. When the eccentricity is separate-eyed, the capacitive coupling is excessive due to the miniaturizing and the capacitive coupling is relatively increased, so that the desirable filter characteristics may not been obtained.

Also, the electric current concentration may occur in part of the short-circuit end face, depending on the space between the small-diameter hole sections, deteriorating a Q value.

If open end-face electrodes are provided, when the miniaturization is further executed, the space between the open end-face electrodes adjacent to each other is to be reduced. Accordingly, the capacitance between the open end-face electrodes is increased. Then, in the same way as in the ultra hetero-axial structure, the capacitive coupling is relatively increased, so that it has been difficult to achieve the required filter characteristics. The pattern of the open end-face electrodes is also miniaturized, so that it has also been difficult to form the pattern with high accuracies.

As described above, in the conventional techniques, the design of filter characteristics in accordance with the miniaturization is limited.

SUMMARY OF THE INVENTION

Accordingly, it is an object of the present invention to provide a dielectric filter and a dielectric duplexer capable of being further miniaturized and achieving required filter characteristics by solving the problems described above.

Furthermore, it is another object to provide a dielectric filter and dielectric duplexer with a Q value of a resonator, which is prevented from being deteriorated even due to the miniaturization, by allowing even the miniaturized dielectric filter and dielectric duplexer to easily adjust the frequency of an attenuation pole.

According to the present invention, by providing open end-face electrodes in a dielectric filter with a cross-eye shaped hetero-axial structure or an ultra hetero-axial structure, a capacitance generated in between each open end-face electrode and an external conductor and a capacitance generated in between the open end-face electrodes adjacent to each other are established such that the inductive coupling between two resonators due to neighboring resonator holes is increased.

In such a configuration, by the capacitance generated between each open end-face electrode and the external conductor and the capacitance generated between open end-face electrodes adjacent to each other, two couplings between the resonators due to the neighboring resonator holes can be adjusted. By increasing the inductive coupling reduced due to the miniaturization, the excessive capacitive coupling can be cancelled, achieving desired filter characteristics.

According to the present invention, a dielectric filter with a separate eye-shaped hetero-axial structure or an ultra hetero-axial structure is provided with open end-face electrodes, and the capacitance generated between each open end-face electrode and an external conductor and the capacitance generated between open end-face electrodes adjacent to each other are established so that two inductive couplings between the resonators due to the neighboring resonator holes are increased.

In such a configuration, by the capacitance generated between each open end-face electrode and the external conductor and the capacitance generated between open end-face electrodes adjacent to each other, two couplings between the resonators due to the neighboring resonator holes can be adjusted. By increasing the inductive coupling reduced due to the miniaturization, the excessive capacitive coupling can be cancelled, achieving desired filter characteristics.

According to the present invention, the open end-face electrodes positioned at both ends of the arranged resonator holes may be arranged such that the area of the resonator hole adjacent to the center of the arrangement is larger than that of the resonator hole having the inner conductor electrically connected to the open end-face electrode.

In such a configuration, the capacitance is generated not only between the open end-face electrodes adjacent to both-end open end-face electrodes but also between the open end-face electrodes of the resonator arranged one step ahead. Then, theses capacitances take action as a multi-pas capacitance, so that the frequency position of the attenuation pole can be controlled by this multi-pas capacitance.

According to the present invention, the dielectric filter may further include electrode projections formed to protrude from the vicinities of the edges, which are perpendicular to the arranging direction of the open end-face electrodes, of the open end-face electrodes positioned at both ends of the arranged resonator holes toward open end-face electrodes adjacent to each other, respectively, so as to generate capacitances to open end-face electrodes different from the respective open end-face electrodes.

By such a configuration, in the open end-face electrodes having the electrode projections, the multi-pass capacitances are generated not only in between the open end-face electrodes adjacent to each other but also in between the open end-face electrodes of one-stage ahead resonators, so that by these the multi-pass capacitances, the attenuation pole can also be controlled.

According to the present invention, the dielectric filter may further include electrode projections formed to protrude from the vicinities of the edges, which are perpendicular to the arranging direction of the open end-face electrodes, of the open end-face electrodes positioned at both ends of the arranged resonator holes toward open end-face electrodes adjacent to each other, respectively, so as to generate capacitances to open end-face electrodes different from the respective open end-face electrodes, in which a plurality of the open end-face electrodes on the open end face are arranged substantially symmetrically about the arranging direction of the resonator holes.

By such a configuration, in the open end-face electrodes having the electrode projections, the multi-pass capacitances are generated not only in between the open end-face electrodes adjacent to each other but also in between the open end-face electrodes of one-stage ahead resonators, so that by these the multi-pass capacitances, the attenuation pole can also be controlled. Since the pattern shape of the open end-face electrodes of the dielectric filter is substantially symmetrical, the filter circuit constant can be designed symmetrically about the input-output directions.

According to the present invention, the plurality of the resonator holes may be arranged such that the distances between the axes on the short-circuit face of the plurality of the resonator holes are equal.

By such a configuration, the intervals of the small-diameter hole sections on the short-circuit face become equal so as to suppress the electric current concentration in the conductors on the short-circuit face. Then, the deterioration of the Q value can be suppressed.

According to the present invention, a dielectric duplexer is configured using any one of or both the cross eye-shaped dielectric filter and the separate eye-shaped dielectric filter.

By such a configuration, even further miniaturized, a dielectric duplexer achieving required filter characteristics can be obtained.

According to the present invention, the input-output electrode for the connection of an antenna may be electrically connected to the conductor formed on the internal surface of the excitation hole, and it may be inter-digitally coupled with the resonator provided on the mounting surface on the short-circuit side neighboring to the excitation hole.

By such a configuration, a part effecting as an external conductor is formed on the open end face, so that the grounding can be sufficiently obtained. Accordingly, a case for grounding is not necessary during mounting, so that the device can be miniaturized.

According to the present invention, the dielectric duplexer may further include an electrode projection formed only in the open side-face electrode electrically connected to the inner conductor of the resonator hole corresponding to the final stage resonator, among the plurality of the open end-face electrodes of the second dielectric filter, the electrode projection protruding from the vicinity of the edge perpendicular to the arranging direction of the plurality of the resonator holes in the direction of an adjacent open end-face electrode so as to generate a capacitance to an open end-face electrode different from the open end-face electrode.

By such a configuration, the open end-face electrode positioned at the final stage when the separate eye-shaped filter is used as a receiving filter is provided with the electrode projection so as to have a capacitance to the other open end-face electrode while the open end-face electrode positioned at the first stage is not provided with the electrode projection so as to have a comparatively small capacitance to the external conductor. By this configuration, the impedance between the input-output electrode for the connection of an antenna and the open end-face electrode can be adapted to the phase synthesis, so that the phase synthesis can be executed with high accuracies.

According to the present invention, a communication apparatus is configured of a high-frequency circuit and at least one of the dielectric filter and the dielectric duplexer that are provided in the high-frequency circuit.

ADVANTAGES OF THE INVENTION

According to the present invention, even further miniaturized, a dielectric filter, a dielectric duplexer, and a communication apparatus having these components that achieve required filter characteristics can be obtained.

REFERENCE NUMERALS

Figure 1:
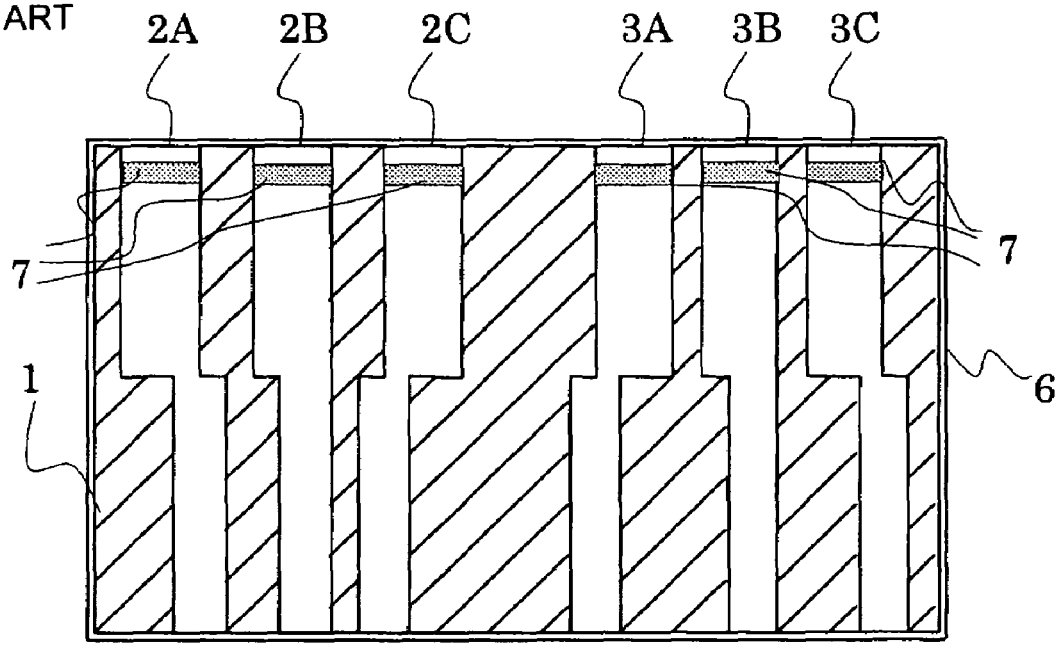
FIG. 1 PRIOR ART
FIG. 1 is a schematic view of a dielectric duplexer having a conventional ultra hetero-axial structure.

1, 11: dielectric block
2, 3, 12, 13, 32, 33, 52, 53, 72, 73: resonator hole
14A: excitation hole
14B: grounding hole
6, 16: external conductor
45, 65, 85: electrode projection
17, 18, 19, 54, 55: input-output electrode
20, 40, 60, 80: transmitting filter
21, 41, 61, 81: receiving filter
22, 23, 42, 43, 62, 63, 82, 83: open end-face electrode
7: electrode non-forming area

DETAILED DESCRIPTION OF THE INVENTION

Figure 2:
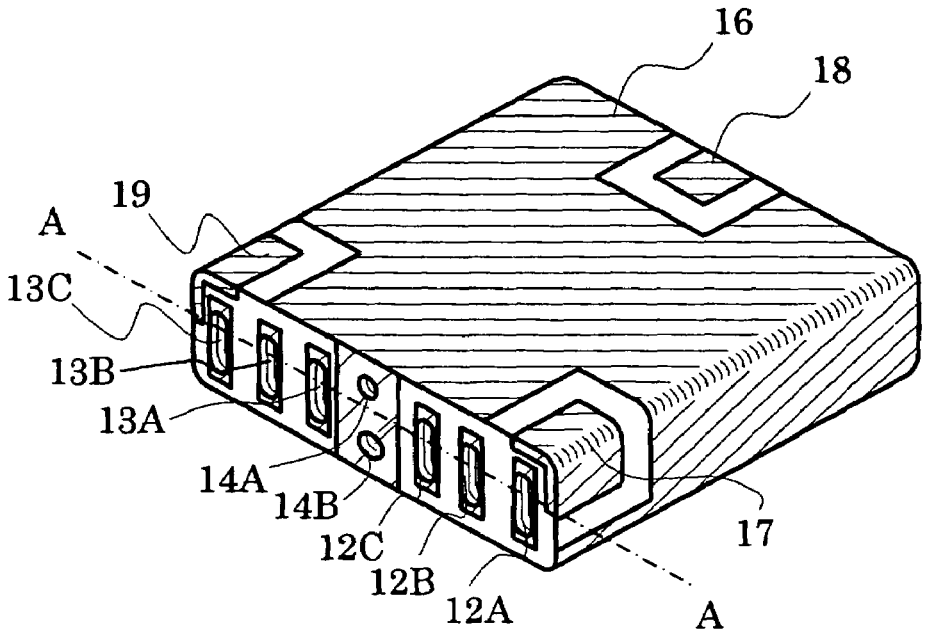
FIG. 2(A) is an external perspective view of a dielectric duplexer according to a first embodiment.
FIG. 2(B) is a sectional view at the line A-A of FIG. 2(A).
Figure 2:
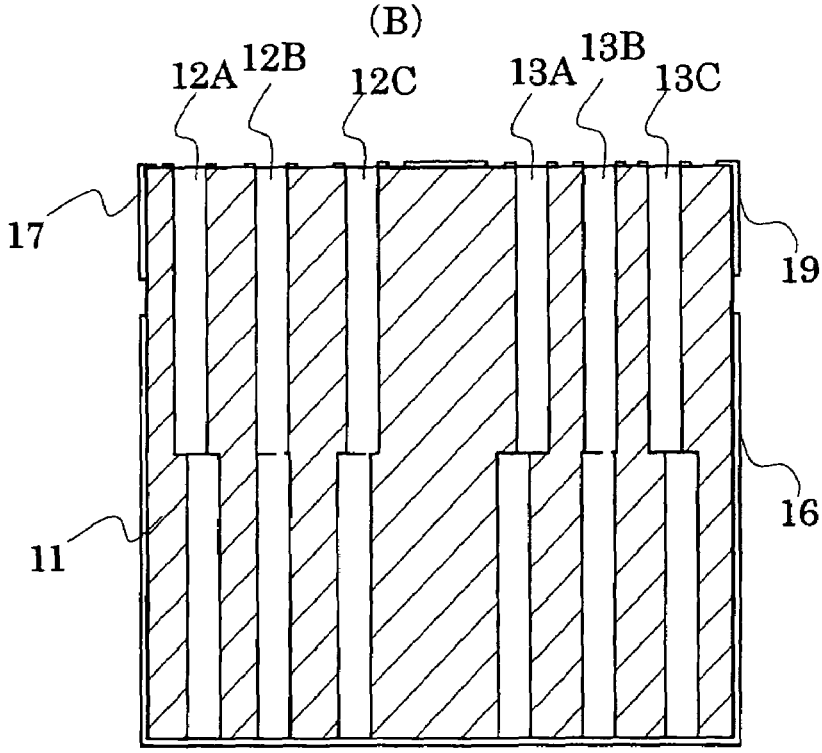

A preferred embodiment for carrying out the present invention will be described below as a first embodiment. FIG. 2(A) is an external perspective view of a dielectric duplexer according to the embodiment; FIG. 2(B) is a sectional view at the line A-A of FIG. 2(A). In FIG. 2(A), the left near face of the drawing is an open end face and the upper face of the drawing is a mounting surface. In FIG. 2(B), the near side of the drawing is the mounting surface.

A dielectric block 11 is provided with a plurality of continuously arranged resonator holes 12A to 12C and 13A to 13C, which are step-shaped and have an ultra hetero-axial structure. Each of the resonator holes is substantially oval-shaped in its cross-section and has an inner conductor formed on its internal surface. The oval cross-section is directed such that its short side is oriented in the arranging direction of the resonator holes while its long side is oriented perpendicularly to the arranging direction so that the length of a large-diameter hole section in the arranging direction agrees with that of a small-diameter hole section. Thereby, the length of the dielectric block is reduced in the arranging direction of the resonator holes.

The resonator holes 12A to 12C are arranged in a cross-eyed shape so as to form a transmitting filter for use in a low-pass frequency of the duplexer. Since the resonator hole 12B is arranged such that the large-diameter hole section is arranged substantially co-axially with the small-diameter hole section, the inductive coupling is made between two resonators adjacent to each other, i.e., between the resonators 12A and 12B and between the resonators 12B and 12C. Hence, the resonator holes 12A to 12C form the filter having two attenuation poles in a high frequency side.

The resonator holes 13A to 13C are arranged in a separate-eyed shape so as to form a receiving filter for use in a high frequency side of the duplexer. Since the resonator hole 13B is arranged such that the large-diameter hole section is arranged substantially co-axially with the small-diameter hole section, the inductive coupling is made between two resonators adjacent to each other, i.e., between the resonators 13A and 13B and between the resonators 13B and 13C. Hence, the resonator holes 13A to 13C form the filter having two attenuation poles in a low frequency side.

The dielectric block 11 is also provided with an excitation hole 14A and a grounding hole 14B formed inside and an external conductor 16 formed outside. Both the excitation hole 14A and the grounding hole 14B, having inner conductors formed inside, are arranged between the resonator hole 12C and the resonator hole 13A so as to be in parallel with the resonator holes 12A to 12C and 13A to 13C. The inner conductor on the inside of the excitation hole 14A is electrically connected to the external conductor 16 on the front left face in the drawing of the dielectric block 11 while being electrically connected to an input-output electrode 18 for an antenna separated from the external conductor 16 on the rear right face in the drawing of the dielectric block 11. This part is interdigitally coupled to the transmitting filter and the receiving filter as an input-output part for an antenna. The inner conductor inside the grounding hole 14B is short-circuited to the external conductor at both ends. By forming a ground conductor where the excitation hole 14A and the grounding hole 14B are electrically connected to the external conductor 16 on the open end face, a case need not be separately provided as before, so that the device can be further miniaturized. On the external surface of the dielectric block 11, an input-output electrode 17 for a transmitting signal and an input-output electrode 19 for a receiving signal are formed along a range from the mounting surface to the side face. The input-output electrodes 17 and 19 are formed so as to generate opposing capacitances to the respective inner conductors of the adjacent resonator holes.

Figure 3:
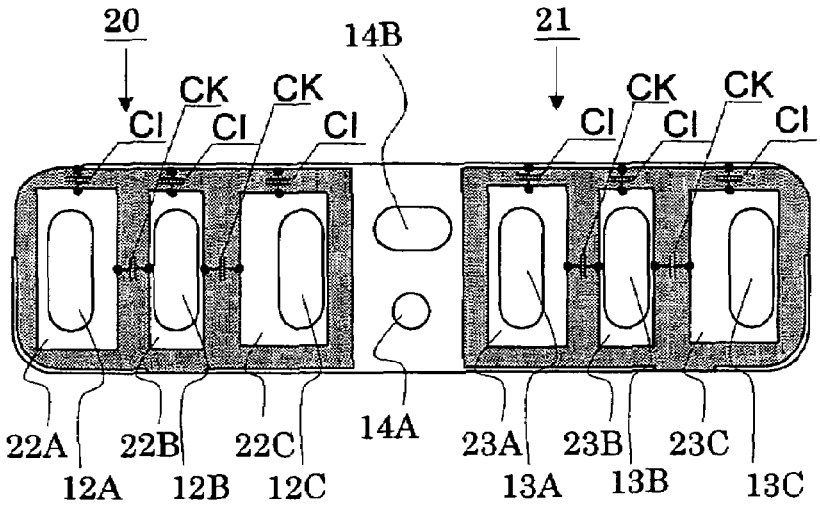
FIG. 3(A) is an external view of the first embodiment viewed from the open end face.
FIG. 3(B) is an external view of the first embodiment viewed from the short-circuit face.
Figure 3:
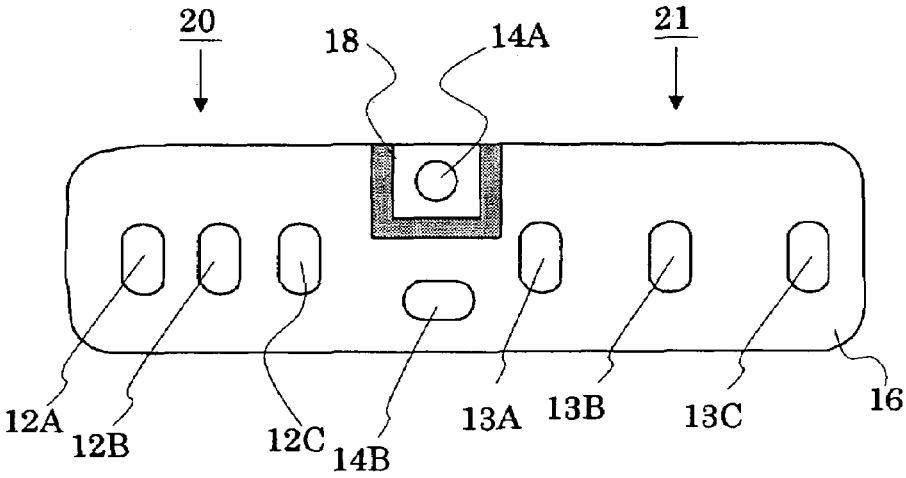

FIG. 3(A) is an external view of the first embodiment viewed from the open end face; FIG. 3(B) is an external view of the first embodiment viewed from the short-circuit face. The capacitance of an open end-face electrode will be described with reference to these drawings.

A plurality of the resonator holes 12A to 12C and 13A to 13C are provided with open end-face electrodes 22A to 22C and 23A to 23C, respectively, which are electrically connected to the inner conductor of each resonator hole and separated from other open end-face electrodes, the external conductor, and the input-output electrodes. The open end-face electrodes 22A to 22C and 23A to 23C herein are simply rectangular, so that the pattern of the open end-face electrodes can be easily formed.

Providing the open end-face electrodes 22A to 22C and 23A to 23C generates mutual capacitances CK between the open end-face electrodes. Between the open end-face electrode and the external conductor, a self capacitance CI is generated. By the mutual capacitance CK, the capacitive coupling between the resonators is relatively increased, whereas, the self capacitance CI operates to reduce the capacitive coupling so as to relatively increase the inductive coupling. By providing two open end-face electrodes among the resonators adjacent to each other, the effect of the generated mutual capacitance CK can be cancelled. Hence, by appropriately setting the self capacitance CI generated in each resonator, the attenuation pole can also be controlled.

The self capacitance CI can be adjusted in each open end-face electrode by the distance to the external conductor and the length of the adjacent side. By the adjustment of the self capacitance CI, the couplings between the resonators due to the respective resonator holes 12A to 12C and 13A to 13C are established. By the establishment, the band width in filter characteristics can be adjusted and the inductivity and the capacitive coupling can be adjusted. For obtaining the large self capacitance CI with the open end-face electrode, by increasing the sum of the self capacitances CI of the respective open end-face electrodes adjacent to each other more than the mutual capacitances CK of the respective open end-face electrodes adjacent to each other, the coupling between the resonators can be generally induced to the inductivity. For example, by setting the sum of the self capacitance CI of the open end-face electrode 22A and the self capacitance CI of the open end-face electrode 22B to be more than the mutual capacitance CK between the open end-face electrodes 22A and 22B, the coupling between the resonator due to the resonator hole 12A and the resonator due to the resonator hole 12B can be comparatively induced to the inductivity in comparison with a case without the open end-face electrode.

As described above, in a cross eye-shaped transmitting filter 20, the self capacitance CI and the mutual capacitance CK are adjusted, so that the inductive coupling of the transmitting filter 20 is secured, generating the attenuation pole in the high pass of the filter characteristics. Also, in a separate eye-shaped receiving filter 21, the self capacitance CI and the mutual capacitance CK are adjusted, so that the inductive coupling of the receiving filter 21 is fairly regulated, generating the attenuation pole in the low pass of the filter characteristics.

According to the first embodiment, the area of the open end-face electrode 22A is set to be small outside the resonator hole 12A and to be large on the side of the open end-face electrode 22B; the area of the open end-face electrode 23C is also set to be small outside the resonator hole 13C and to be large on the side of the open end-face electrode 23B. By adjusting the areas in such a manner, the attenuation pole in filter characteristics can also be regulated more efficiently.

Then, the effect of the setting the areas in such a manner will be described. When the space between the resonators is small, the inductive coupling may be generated between the resonators not neighboring each other. The inductive coupling between the resonators not neighboring each other needs to be cancelled by providing an open end-face electrode.

Accordingly, hereinafter, by reducing the distance between the open end-face electrodes 22A and 22C so as to adjust the area of the open end-face electrode 22A, a capacitance CM between the open end-face electrodes 22A and 22C (referred to as a multi-pass capacitance below) is generated.

This multi-pass capacitance CM operates to reduce the inductive coupling between the resonators so as to relatively increase the capacitive coupling, so that the inductive coupling between the resonators not neighboring each other can be cancelled. Hence, by appropriately setting the multi-pass capacitance CM generated in each resonator, the attenuation pole can also be controlled.

In order to adjust the multi-pass capacitance CM, the self capacitance CI, and the mutual capacitance CK, a comparatively large open end-face electrode is formed in a manufacturing process; then, the open end-face electrode may be deleted in the adjusting process using various methods such as a laser beam and a rooter.

As described above, by providing an open end-face electrode, a dielectric duplexer having desired filter characteristics and a size smaller than before can be obtained even from a stepped resonator hole with an ultra hetero-axial structure or a hetero-axial structure. Also the degree of freedom can be improved in designing the arrangements of a large-diameter hole section on the open end-face side and a small-diameter hole section on the short-circuit face side.

According to the embodiment, the shape of the open end-face electrode is not limited to a rectangle, so that any shape can be incorporated as long as the self capacitance and the mutual capacitance are established as described above.

The input-output electrode for connecting an antenna is inter-digitally coupled using the excitation hole; however, the invention is not limited to this configuration, so that an electrode separated from the external conductor may be used as the input-output electrode by allowing it to oppose the inner conductor of any resonator hole without being limited to the electrode shape. The input electrode of the transmitting filter or the output of the receiving filter may also be inter-digitally coupled using the excitation hole, so that the present invention may be incorporated without limitation to the input-output electrode shape.

The cross-section of the resonator hole or the excitation hole perpendicular to the axial direction is not limited to an oval, so that any shape, such as a circle, a rectangle, and an ellipse, may incorporate the invention. The dimension may also not be unified among the resonator holes.

According to the embodiment, a stepped hole with an ultra hetero-axial structure is provided; alternatively, the hole may have a simple hetero-axial structure with a small eccentricity between the large-diameter hole section and the small-diameter hole section. Any of the step ratio between the large-diameter hole section and the small-diameter hole section and the cross-sectional shape thereof may be incorporated to the invention. The intervals between the resonator holes may also not be constant. In such a manner, any of the large-diameter hole section and the small-diameter hole section may be incorporated to the present invention.

According to the embodiment, a dielectric duplexer is exemplified that has a transmitting filter and a receiving filter provided in a single dielectric block. The present invention is not limited to the dielectric duplexer, so that the same advantages can also be obtained for a dielectric filter.

Next, a preferred embodiment for carrying out the present invention will be described below as a second embodiment. In the second embodiment, only the shape of an open end-face electrode is differentiated from that of the first embodiment.

Figure 4:
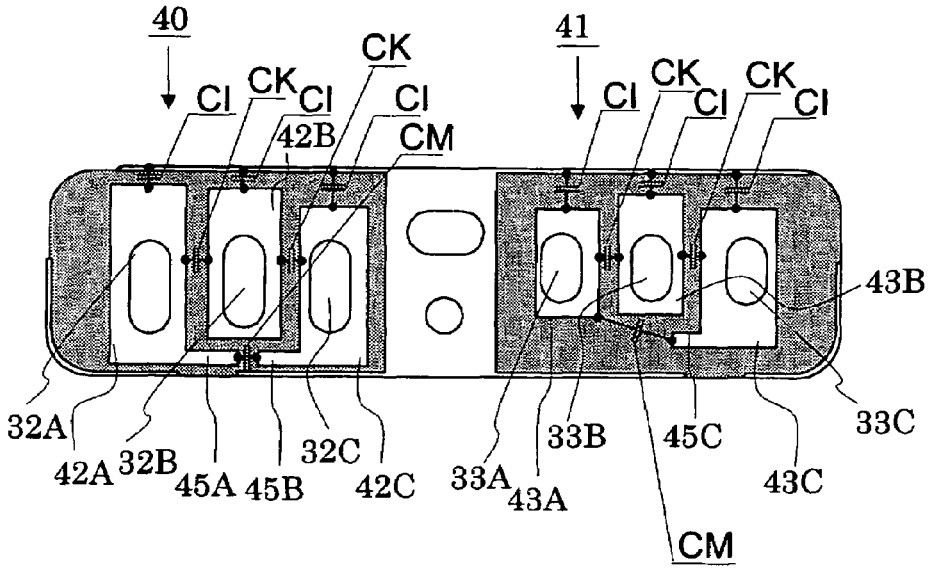
FIG. 4 is a front view of the open end face of a dielectric duplexer according to a second embodiment.

FIG. 4 is an external view of the second embodiment viewed from an open end face. According to the second embodiment, open end-face electrodes 42A, 42C, and 43C are provided with electrode projections 45A, 45B, and 45C, respectively. The respective electrode projections 45A, 45B, and 45C have a rectangular shape with a narrow width, such that its edge side is extended toward the respective filter center from the edge of the respective open end-face electrodes 42A, 42C, and 43C adjacent to the mounting surface. By shaping the projection in a rectangle in such a manner, the pattern can be easily formed. The electrode projections 45A, 45B, and 45C may be displaced to some extent upwardly or downwardly in FIG. 4, and they may have any shape as long as they are not electrically connected to other open end-face electrodes, external conductors, and input-output electrodes.

The capacitances due to the open end-face electrodes 42A to 42C and 43A to 43C and the electrode projections 45A, 45B, and 45C will be described below with reference to FIG. 4.

By providing the open end-face electrodes 42A to 42C and 43A to 43C, the mutual capacitance CK is generated between open end-face electrodes. Between the open end-face electrode and the external conductor, the self capacitance CI is also generated. By the mutual capacitance CK, the capacitive coupling between resonators is relatively increased, whereas, the self capacitance CI operates to reduce the capacitive coupling by contrast to the mutual capacitance CK so as to relatively increase the inductive coupling. Because of this, the effect of the mutual capacitance CK, which is generated by providing the open end-face electrode between two resonators adjacent to each other, can be cancelled. Hence, the self capacitance CI generated in each resonator is appropriately established so as to have the attenuation pole by determining the coupling between the resonators.

According to the second embodiment, the open end-face electrodes 42A, 42C, and 43C are provided with the electrode projections 45A, 45B, and 45C, respectively. The electrode projections 45A, 45B, and 45C generate multi-pass capacitance CM between open end-face electrodes not neighboring each other so as to be operated as a multi-pass electrode. Accordingly, with the shapes of the electrode projections 45A, 45B, and 45C, the attenuation pole of filter characteristics can be adjusted.

Figure 8:
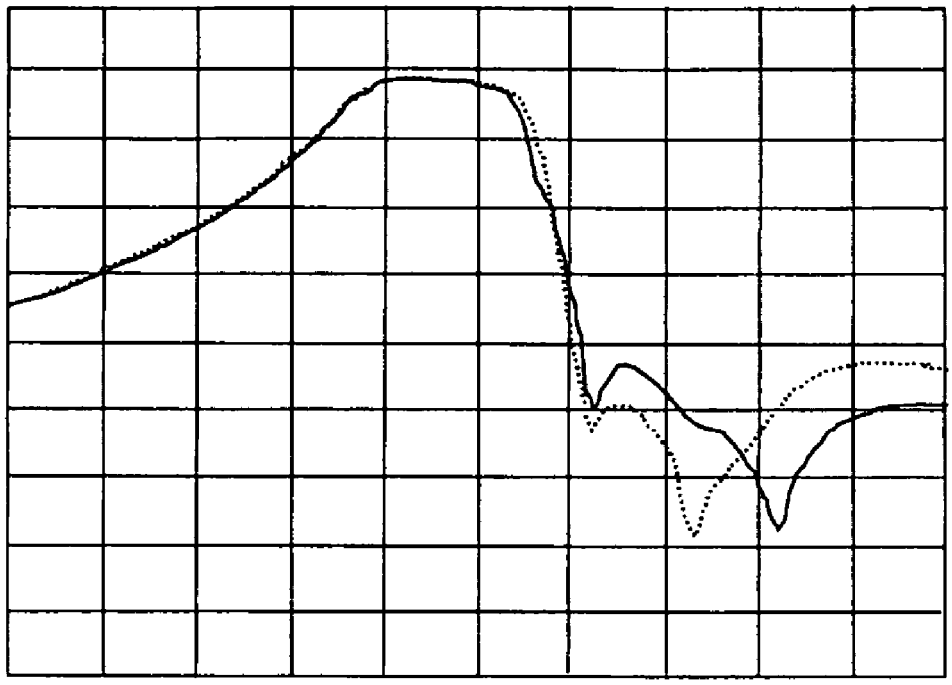
FIG. 8(A) is a graph showing the frequency characteristics of a transmiffing filter.
FIG. 8(B) is a graph showing the frequency characteristics of a receiving filter.
Figure 8:
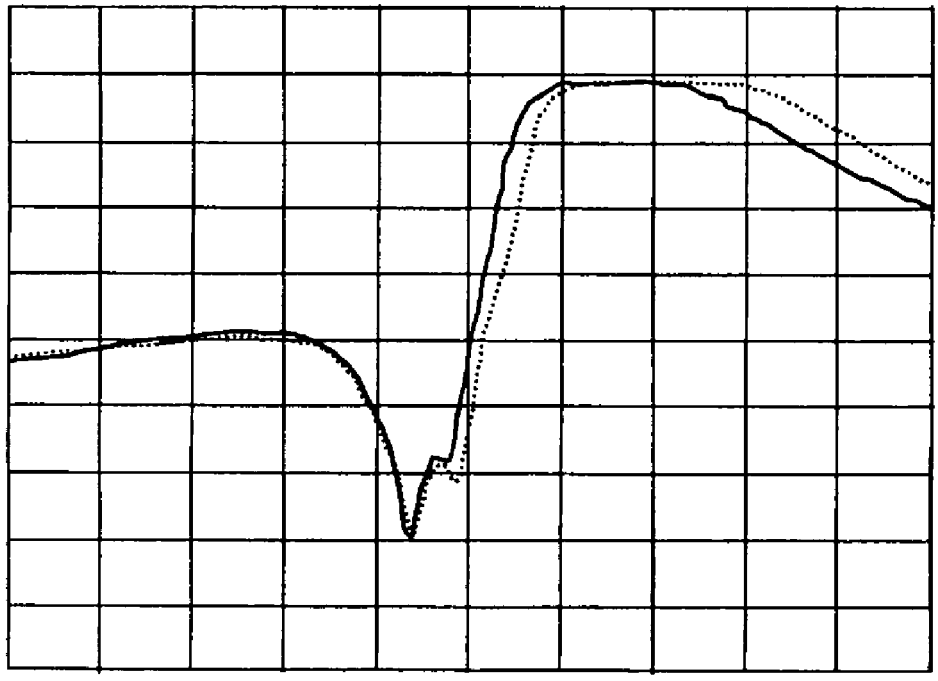

The advantageous effect of the electrode projections 45A, 45B, and 45C will be described below with reference to the frequency characteristic diagram of FIG. 8. FIG. 8(A) is an example showing the frequency characteristics of a transmitting filter 40; FIG. 8(B) is an example showing the frequency characteristics of a receiving filter 41. In both FIGS. 8(A) and 8(B), the presence of the electrode projection is indicated by the frequency characteristics, in which solid lines show the absence of the electrode projection without the generated multi-pass capacitance CM and dotted lines show the presence of the electrode projection with the generated multi-pass capacitance CM.

In general, when the space between the resonators is small, inductive coupling may be generated between resonators not neighboring each other. The inductive coupling between the resonators not neighboring each other can be cancelled by providing the open end face electrode between the resonators not neighboring each other.

Therefore, in the transmitting filter 40, the electrode projections 45A and 45B are protruded from the respective open end face electrodes, such that the open end-face electrode 42A approaches the open end-face electrode 42C. Then, the multi-pass capacitance CM is generated between the electrode projections 45A and 45B. Since the multi-pass capacitance CM operates to reduce the inductive coupling so as to relatively increase the capacitive coupling, the inductive coupling between the resonators not neighboring each other can be cancelled. Hence, by appropriately establishing the multi-pass capacitance CM generated in each resonator, the attenuation pole can be controlled.

Specifically, when the electrode projection is not present in the transmitting filter 40, as shown by the solid line of FIG. 8(A), two attenuation poles respectively generated between resonator holes 32A and 32B and between resonator holes 32B and 32C are excessively separated from each other, so that required characteristics may not be satisfied. Then, by creating the multi-pass capacitance CM using the electrode projection, as shown by the dotted line of FIG. 8(A), two attenuation poles respectively generated between resonator holes 32A and 32B and between resonator holes 32B and 32C can be approximated to some extent. When the multi-pass capacitance CM is present, as shown in the drawing, the two attenuation poles can be approximated so as to rapidly increase the attenuation.

When the electrode projections are provided in both the open end face electrodes positioned at both ends of the resonator holes continuously arranged in such a manner, and the open end-face electrodes 42A and 42C are arranged symmetrically, with shape similarity, other parts of the transmitting filter can also be arranged symmetrically about the input-output direction, so that design is easily facilitated.

In the receiving filter 41, the electrode projection 45C is protruded from the open end face electrode 43C, such that the open end-face electrode 43A approaches the open end-face electrode 43C. Then, the multi-pass capacitance CM is generated in between the electrode projections 43A and 45C. By the multi-pass capacitance CM, the inductive coupling between the resonators not neighboring each other can be cancelled. Hence, by appropriately establishing the multi-pass capacitance CM generated in each resonator, the attenuation pole can be controlled.

Specifically, when the electrode projection 45C is not present in the receiving filter 41, as shown by the solid line of FIG. 8(B), two attenuation poles respectively generated between resonator holes 33A and 33B and between resonator holes 33B and 33C almost agree with each other, so that required characteristics may not be satisfied. Then, by obtaining the multi-pass capacitance CM using the electrode projection 45C as shown by the dotted line of FIG. 8(B), two attenuation poles respectively generated between resonator holes 33A and 33B and between resonator holes 33B and 33C can be separated. When the multi-pass capacitance CM is present, the two attenuation poles respectively generated between resonator holes 33A and 33B and between resonator holes 33B and 33C can be separated comparatively so as to rapidly increase the attenuation.

In such a manner, when the electrode projection 45C is provided only in the open end-face electrode 43C of the resonator in the final stage of the receiving filter 41, the attenuation poles can be controlled as well as the capacitance generated to the external conductor can be reduced to be comparatively small in the resonator 43A in the first stage of the receiving filter 41. Thereby, the impedance between the input-output electrode for the connection of an antenna and the open end-face electrode can be adapted to the phase synthesis, so that the phase synthesis can be executed with high accuracy.

According to the second embodiment, the transmitting filter 40 is provided with electrode projections formed in the open end-face electrodes of both the first stage and the final stage resonators, respectively, while the receiving filter 41 is provided with an electrode projection formed only in the open end-face electrode 43C of the final stage resonator; alternatively, the electrode projections may be provided in the open end-face electrodes of both the first stage and the final stage resonators of the receiving filter 41 or may also be provided in any one of them. The electrode projection may also be provided in any one of the open end-face electrodes of the first stage and the final stage resonators of the transmitting filter 40.

In order to adjust the multi-pass capacitance CM, a comparatively large electrode projection is formed in a manufacturing process; then, the length of the electrode projection may be regulated in the adjusting process using various methods such as a laser beam and a rooter.

Next, a preferred embodiment for carrying out the present invention will be described below as a third embodiment. In the third embodiment, the shape of an open end-face electrode is further differentiated from that of the second embodiment.

Figure 5:
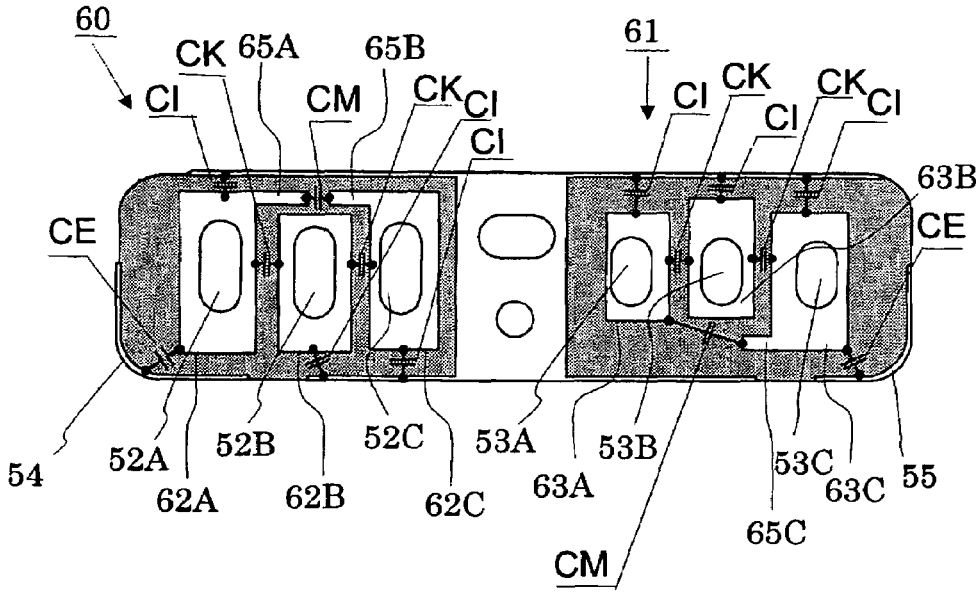
FIG. 5 is a front view of the open end face of a dielectric duplexer according to a third embodiment.

FIG. 5 is an external view of the third embodiment viewed from an open end face. According to the third embodiment, a plurality of resonator holes 52A to 52C and 53A to 53C are provided with open end-face electrodes 62A to 62C and 63A to 63C, respectively. The open end-face electrodes 62A, 62C, and 63C are also provided with electrode projections 65A, 65B, and 65C, respectively. The respective open end-face electrodes 62B, 63A, and 63B are rectangular shaped.

In a transmitting filter 60, the electrode projections 65A and 65B are arranged on a side opposing the mounting surface shown in the upper portion of FIG. 5. In a receiving filter 61, the electrode projection 65C is arranged on a side agreeing with the mounting surface shown in the lower portion of FIG. 5.

In the transmitting filter 60, by arranging the electrode projections 65A and 65B on the side opposing the mounting surface, the multi-pass capacitance CM is generated between the open end-face electrodes 62A and 62C as well as the self capacitance CI of the open end-face electrode 62A can be increased comparatively. On a side of the open end-face electrode 62A agreeing with the mounting surface, not the external conductor but an input-output electrode 54 is generally formed, so that the effective dielectric constant of the vicinity of the input-output electrode 54 is substantially reduced. Hence, if the electrode projection is assumed to be formed on the side of the open end-face electrode 62A agreeing with the mounting surface, the effect to increase the self capacitance CI of the open end-face electrode 62A cannot be obtained. Whereas, according to the third embodiment, by providing the electrode projection 65A on the side opposing the mounting surface, the self capacitance CI of the open end-face electrode 62A can be increased comparatively.

In the receiving filter 61, by arranging the electrode projection 65C on the side agreeing with the mounting surface, a capacitance (an external linkage capacitance) Ce between the open end-face electrode 63C and the input-output electrode 55 can also be increased.

According to the third embodiment, in the transmitting filter 60 the electrode projections 65A and 65B are arranged on a side opposing the mounting surface, while in the receiving filter 61 the electrode projection 65C is arranged on a side agreeing with the mounting surface. However, the present invention is not limited to such a configuration, and the electrode projections may be provided on any one of the sides opposing the mounting surface and agreeing with the mounting surface, and on any one of the transmitting filter and the receiving filter.

Next, a preferred embodiment for carrying out the present invention will be described below as a fourth embodiment. In the fourth embodiment, intervals of resonator holes are differentiated from those of the third embodiment.

Figure 6:
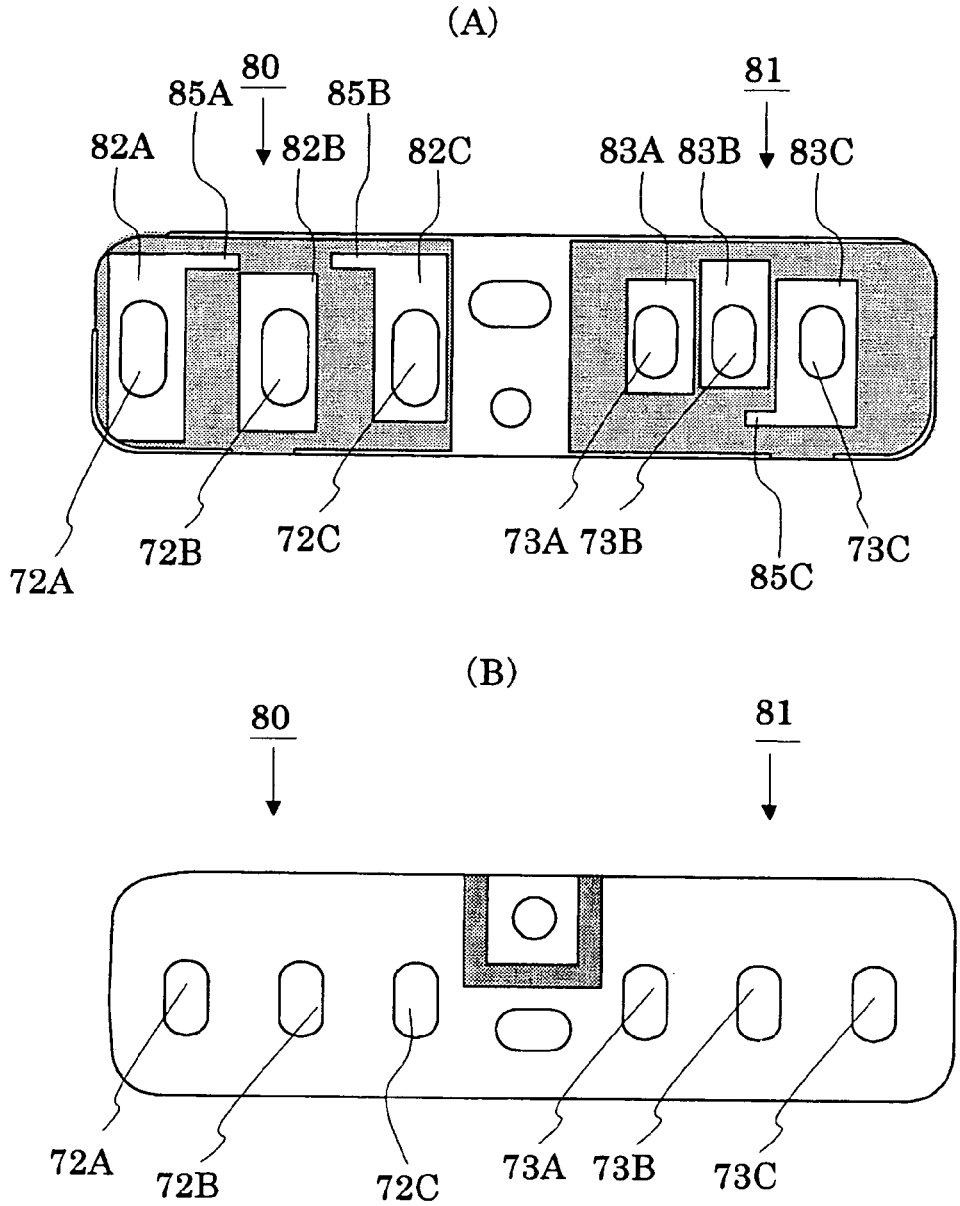
FIG. 6(A) is an external view of a fourth embodiment viewed from an open end face.
FIG. 6(B) is an external view of the fourth embodiment viewed from a short-circuit face.

FIG. 6(A) is an external view of the fourth embodiment viewed from an open end face; FIG. 6(B) is an external view of the fourth embodiment viewed from a short-circuit face. According to the fourth embodiment, a plurality of resonator holes 72A to 72C and 73A to 73C are arranged on the short-circuit face at approximately equal intervals. On an open end face, open end-face electrodes 82A to 82C and 83A to 83C and electrode projections 85A to 85C are provided. By providing the open end face electrodes 82A to 82C and 83A to 83C, a mutual capacitance is generated between the open end face electrodes. Between the open end face electrode and the external conductor, a self capacitance is also generated. A multi-pass capacitance is also generated due to the electrode projections 85A to 85C. By the mutual capacitance, the capacitive coupling between the resonators is relatively increased, whereas, the self capacitance operates to reduce the capacitive coupling so as to relatively increase the inductive coupling. By providing two open end-face electrodes among the resonators adjacent to each other, the effect of the generated mutual capacitance can be cancelled. Hence, the self capacitance generated in each resonator can be appropriately set. Since by the multi-pass capacitance, the inductive coupling between the resonators not neighboring each other can be cancelled, the attenuation pole can be controlled by appropriately setting the multi-pass capacitance.

The resonator holes 72A to 72C and 73A to 73C on the short-circuit face herein are arranged at approximately equal intervals. Hence, the intervals of the open end-face electrodes 82A to 82C of a transmitting filter 80 are comparatively large and the intervals of the open end-face electrodes 83A to 83C of a receiving filter 81 are comparatively small.

In such a manner, when small-diameter hole sections on the short-circuit face side are arranged at approximately equal intervals, an electric current flows substantially uniformly through the resonator holes on the short-circuit face side and the external conductors on the short-circuit face, suppressing the current concentration. Hence, the Q value of the whole dielectric duplexer can be optimized.

Since the small-diameter hole sections on the short-circuit face side are arranged at substantially equal intervals, and although the arrangement of the large-diameter hole sections on the open end-face side is largely limited because self capacitance from the open end-face electrodes is obtained, the desired attenuation pole can be obtained even when the eccentricity of the resonator holes is reduced.

Figure 7:
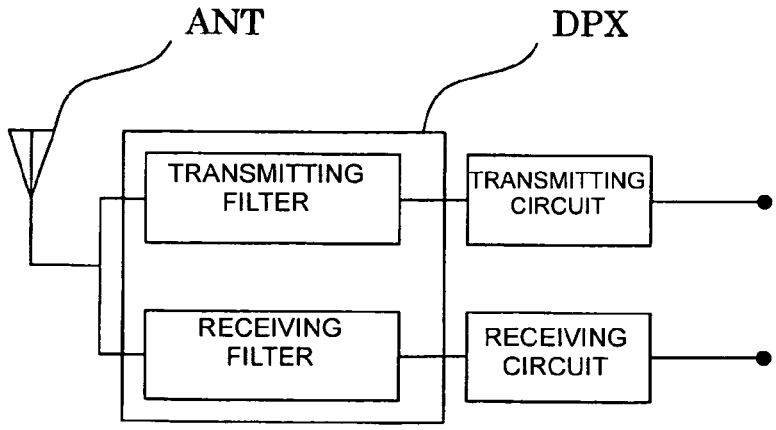
FIG. 7 is a block diagram of a communication apparatus according to a fifth embodiment.

Next, a configuration of a communication apparatus as a fifth embodiment in the preferred embodiments for carrying out the present invention is shown in the block diagram of FIG.7. Referring to FIG. 7, a duplexer DPX uses the dielectric duplexer according to the fourth embodiment described above. On a circuit board, the duplexer DPX is mounted such that the input-output electrode of the transmitting filter is connected to a transmitting circuit, the input-output electrode of the receiving filter is connected to a receiving circuit, and an antenna ANT is connected to the antenna electrode of the duplexer DPX.

The invention claimed is:

1. A filter comprising:

a dielectric block;

external conductors on faces other than one face of the dielectric block;

an input-output electrode on a mounting surface perpendicular to the one face of the dielectric block, the input-output electrode being separated from the external conductors, the one face of the dielectric block is an open end face and a face opposing the open end face is a short-circuit face;

a plurality of continuously arranged and step-shaped holes, which pass through the dielectric block between the open end face and the short-circuit face in parallel with the mounting surface, each respective step-shaped hole having a larger cross-section adjacent to the open end face and a smaller cross-section adjacent to the short-circuit face;

inner conductors on internal surfaces of each of the plurality of step-shaped holes so as to form a plurality of resonator holes;

respective open end-face electrodes on the open end face and electrically connected to the respective inner conductors of the plurality of resonator holes separately from the external conductor, wherein, in respective resonator holes positioned at both ends of the plurality of resonator holes, an axis of a first hole adjacent to the open end face is deviated from that of a second hole adjacent to the short-circuit face so that a distance on the open end surface between axes of the resonator holes positioned at both ends is greater than that on the short-circuit surface, wherein in the open end-face electrodes of the resonator holes positioned at both ends of the plurality of resonator holes, an area of an electrode adjacent to a central resonator hole of the plurality of resonator holes is greater than that of the electrode opposite thereto so as to generate a first capacitance between the open end-face electrodes of the resonator holes positioned at both ends of the plurality of resonator holes, and wherein the plurality of resonator holes are arranged such that a second capacitance generated between each open end electrode of the plurality of resonator holes and the external conductor and a third capacitance generated between the open end electrodes adjacent to each other are established so that inductive coupling is increased between neighboring resonator holes.

2. The filter according to claim 1, wherein the open end-face electrode positioned at at least one end of the plurality of resonator holes includes an electrode-protruding part protruding toward a central resonator hole of the plurality of resonator holes from a vicinity of an edge perpendicular to an arranging direction of the plurality of resonator holes, and the open end-face electrodes of the resonator holes positioned at both ends of the plurality of resonator holes are configured to generate the first capacitance by opposing each other via the electrode-protruding part.

3. The filter according to claim 2, wherein the respective open end-face electrodes of the plurality of resonator holes are arranged substantially symmetrically about an arranging direction of the plurality of resonator holes.

4. The filter according to claim 1, wherein the plurality of resonator holes on the short-circuit face are arranged such that distances between their respective axes are equal.

5. A filter comprising:

a dielectric block;

external conductors on faces other than one face of the dielectric block;

an input-output electrode on a mounting surface perpendicular to the one face of the dielectric block, the input-output electrode being separated from the external conductors, the one face of the dielectric block is an open end face and a face opposing the open end face is a short-circuit face;

a plurality of continuously arranged and step-shaped holes, which pass through the dielectric block between the open end face and the short-circuit face in parallel with the mounting surface, each respective step-shaped hole having a larger cross-section adjacent to the open end face and a smaller cross-section adjacent to the short-circuit face;

inner conductors on internal surfaces of each of the plurality of step-shaped holes so as to form a plurality of resonator holes;

respective open end-face electrodes on the open end face and electrically connected to the respective inner conductors of the plurality of resonator holes separately from the external conductor, wherein, in respective resonator holes positioned at both ends of the plurality of resonator holes, an axis of a first hole adjacent to the open end face is deviated from that of a second hole adjacent to the short-circuit face so that a distance on the open end surface between axes of the resonator holes positioned at both ends is shorter than that on the short-circuit face, wherein in the respective open end-face electrodes of the resonator holes positioned at both ends of the plurality of resonator holes, an area of an electrode adjacent to a central resonator hole of the plurality of resonator holes is greater than that of the electrode opposite thereto so as to generate a first capacitance between the open end-face electrodes of the resonator holes positioned at both ends of the plurality of resonator holes, and wherein the plurality of resonator holes are arranged such that a second capacitance generated between each open end electrode of the plurality of resonator holes and the external conductor and a third capacitance generated between the open end electrodes adjacent to each other are established so that inductive coupling is increased between neighboring resonator holes.

6. The filter according to claim 5, wherein the open end-face electrode positioned at at least one end of the plurality of resonator holes includes an electrode-protruding part protruding toward a central resonator hole of the plurality of resonator holes from a vicinity of an edge perpendicular to an arranging direction of the plurality of resonator holes, and the open end-face electrodes of the resonator holes positioned at both ends of the plurality of resonator holes are configured to generate the first capacitance by opposing each other via the electrode-protruding part.

7. The filter according to claim 6, wherein the respective open end-face electrodes of the plurality of resonator holes are arranged substantially symmetrically about an arranging direction of the plurality of resonator holes.

8. The filter according to claim 5, wherein the plurality of resonator holes on the short-circuit face are arranged such that distances between their respective axes are equal.

9. A filter comprising:

a dielectric block;

external conductors on faces other than one face of the dielectric block;

an input-output electrode on a mounting surface perpendicular to the one face of the dielectric block, the input-output electrode being separated from the external conductors, the one face of the dielectric block is an open end face and a face opposing the open end face is a short-circuit face;

a plurality of continuously arranged and step-shaped holes, which pass through the dielectric block between the open end face and the short-circuit face in parallel with the mounting surface, each respective step-shaped hole having a larger cross-section adjacent to the open end face and a smaller cross-section adjacent to the short-circuit face;

inner conductors on internal surfaces of each of the plurality of step-shaped holes so as to form a plurality of resonator holes;

respective open end-face electrodes on the open end face and electrically connected to the respective inner conductors of the plurality of resonator holes separately from the external conductor, wherein, in respective resonator holes positioned at both ends of the plurality of resonator holes, an axis of a first hole adjacent to the open end face is deviated from that of a second hole adjacent to the short-circuit face so that a distance on the open end surface between axes of the resonator holes positioned at both ends is greater than that on the short-circuit surface, wherein the open end-face electrode of the resonator hole positioned at at least one end of the plurality of resonator holes includes an electrode-protruding part protruding toward a central resonator hole of the plurality of resonator holes from a vicinity of an edge perpendicular to an arranging direction of the plurality of resonator holes, and the open end-face electrodes of the resonator holes positioned at both ends of the plurality of resonator holes are configured to generate a first capacitance by opposing each other via the electrode-protruding part, and wherein the plurality of resonator holes are arranged such that a second capacitance generated between each open end electrode of the plurality of resonator holes and the external conductor and a third capacitance generated between the open end electrodes adjacent to each other are established so that inductive coupling is increased between neighboring resonator holes.

10. The filter according to claim 9, wherein the respective open end-face electrodes positioned at both ends of the plurality of resonator holes are arranged such that an area of the resonator hole adjacent to a center of the arrangement is greater than that of an electrode opposite thereto so as to generate the first capacitance between the open end-face electrodes of the resonator holes positioned at both ends of the plurality of resonator holes.

11. The filter according to claim 9, wherein the respective open end-face electrodes of the plurality of resonator holes are arranged substantially symmetrically about an arranging direction of the plurality of resonator holes.

12. The filter according to claim 9, wherein the plurality of resonator holes on the short-circuit face are arranged such that distances between their respective axes are equal.

13. A filter comprising:

a dielectric block;

external conductors on faces other than one face of the dielectric block;

an input-output electrode on a mounting surface perpendicular to the one face of the dielectric block, the input-output electrode being separated from the external conductors, the one face of the dielectric block is an open end face and a face opposing the open end face is a short-circuit face;

a plurality of continuously arranged and step-shaped holes, which pass through the dielectric block between the open end face and the short-circuit face in parallel with the mounting surface, each respective step-shaped hole having a larger cross-section adjacent to the open end face and a smaller cross-section adjacent to the short-circuit face;

inner conductors on internal surfaces of each of the plurality of step-shaped holes so as to form a plurality of resonator holes;

respective open end-face electrodes on the open end face and electrically connected to the respective inner conductors of the plurality of resonator holes separately from the external conductor, wherein, in respective resonator holes positioned at both ends of the plurality of resonator holes, an axis of a first hole adjacent to the open end face is deviated from that of a second hole adjacent to the short-circuit face so that a distance on the open end surface between axes of the resonator holes positioned at both ends is shorter than that on the short-circuit surface, wherein the open end-face electrode of the resonator hole positioned at at least one end of the plurality of resonator holes includes an electrode-protruding part protruding toward a central resonator hole of the plurality of resonator holes from a vicinity of an edge perpendicular to an arranging direction of the plurality of resonator holes, and the open end-face electrodes of the resonator holes positioned at both ends of the plurality of resonator holes are configured to generate a first capacitance by opposing each other via the electrode-protruding part, and wherein the plurality of resonator holes are arranged such that a second capacitance generated between each open end electrode of the plurality of resonator holes and the external conductor and a third capacitance generated between the open end electrodes adjacent to each other are established so that inductive coupling is increased between neighboring resonator holes.

14. The filter according to claim 13, wherein the respective open end-face electrodes positioned at both ends of the plurality of resonator holes are arranged such that an area of the resonator hole adjacent to a center of the arrangement is greater than that of an electrode opposite thereto so as to generate the first capacitance between the open end-face electrodes of the resonator holes positioned at both ends of the plurality of resonator holes.

15. The filter according to claim 13, wherein the respective open end-face electrodes of the plurality of resonator holes are arranged substantially symmetrically about an arranging direction of the plurality of resonator holes.

16. The filter according to claim 13, wherein the plurality of resonator holes on the short-circuit face are arranged such that distances between their respective axes are equal.

17. A dielectric duplexer comprising:

first and second dielectric filters, wherein at least one of the first and second dielectric filters is the dielectric filter according to claim 1; and an input-output electrode connecting an antenna arranged between the first and second dielectric filters, the input-output electrode outputting an output signal from the first dielectric filter and inputting an input signal to the second dielectric filter.

18. The duplexer according to claim 17, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, and wherein an electrode formed along an area from the mounting surface toward the short-circuit face separately from the external conductor is electrically connected to the inner conductor on the internal surface of the excitation hole so as to have the input-output electrode for the connection of an antenna.

19. A dielectric duplexer comprising:

first and second dielectric filters, wherein the first dielectric filter is the dielectric filter according to claim 1; and an input-output electrode connecting an antenna arranged between the first and second dielectric filters, the input-output electrode outputting an output signal from the first dielectric filter and inputting an input signal to the second dielectric filter, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face wherein an electrode formed along an area from the mounting surface toward the short-circuit face separately from the external conductor is electrically connected to the inner conductor on the internal surface of the excitation hole so as to have the input-output electrode for the connection of an antenna, and wherein only an open end-face electrode corresponding to a final stage resonator in a plurality of the open end-face electrodes of the second dielectric filter includes an electrode-protruding part protruding toward a central resonator hole of the plurality of resonator holes of the second dielectric filter from a vicinity of an edge perpendicular to an arranging direction of the plurality of resonator holes of the second dielectric filter, and the open end-face electrodes of the resonator holes positioned at both ends of the plurality of resonator holes of the second dielectric filter are configured to generate the first capacitance by opposing each other via the electrode-protruding part.

20. A dielectric duplexer comprising:

first and second dielectric filters, wherein at least one of the first and second dielectric filters is the dielectric filter according to claim 5; and an input-output electrode connecting an antenna arranged between the first and second dielectric filters, the input-output electrode outputting an output signal from the first dielectric filter and inputting an input signal to the second dielectric filter.

21. The duplexer according to claim 20, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, and wherein an electrode formed along an area from the mounting surface toward the short-circuit face separately from the external conductor is electrically connected to the inner conductor on the internal surface of the excitation hole so as to have the input-output electrode for the connection of an antenna.

22. A dielectric duplexer comprising:

first and second dielectric filters, wherein the first dielectric filter is the dielectric filter according to claim 5; and an input-output electrode connecting an antenna arranged between the first and second dielectric filters, the input-output electrode outputting an output signal from the first dielectric filter and inputting an input signal to the second dielectric filter, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, wherein an electrode formed along an area from the mounting surface toward the short-circuit face separately from the external conductor is electrically connected to the inner conductor on the internal surface of the excitation hole so as to have the input-output electrode for the connection of an antenna, and wherein only an open end-face electrode corresponding to a final stage resonator in a plurality of the open end-face electrodes of the second dielectric filter includes an electrode-protruding part protruding toward a central resonator hole of the plurality of resonator holes of the second dielectric filter from a vicinity of an edge perpendicular to an arranging direction of the plurality of resonator holes of the second dielectric filter, and the open end-face electrodes of the resonator holes positioned at both ends of the plurality of resonator holes of the second dielectric filter are configured to generate the first capacitance by opposing each other via the electrode-protruding part.

23. A dielectric duplexer comprising:

first and second dielectric filters, wherein at least one of the first and second dielectric filters is the dielectric filter according to claim 9; and an input-output electrode connecting an antenna arranged between the first and second dielectric filters, the input-output electrode outputting an output signal from the first dielectric filter and inputting an input signal to the second dielectric filter.

24. The duplexer according to claim 23, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, and wherein an electrode formed along an area from the mounting surface toward the short-circuit face separately from the external conductor is electrically connected to the inner conductor on the internal surface of the excitation hole so as to have the input-output electrode for the connection of an antenna.

25. A dielectric duplexer comprising:

first and second dielectric filters, wherein the first dielectric filter is the dielectric filter according to claim 9; and an input-output electrode connecting an antenna arranged between the first and second dielectric filters, the input-output electrode outputting an output signal from the first dielectric filter and inputting an input signal to the second dielectric filter, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, wherein an electrode formed along an area from the mounting surface toward the short-circuit face separately from the external conductor is electrically connected to the inner conductor on the internal surface of the excitation hole so as to have the input-output electrode for the connection of an antenna, and wherein only an open end-face electrode corresponding to a final stage resonator in a plurality of the open end-face electrodes of the second dielectric filter includes an electrode-protruding part protruding toward a central resonator hole of the plurality of resonator holes of the second dielectric filter from a vicinity of an edge perpendicular to an arranging direction of the plurality of resonator holes of the second dielectric filter, and the open end-face electrodes of the resonator holes positioned at both ends of the plurality of resonator holes of the second dielectric filter are configured to generate the first capacitance by opposing each other via the electrode-protruding part.

26. A dielectric duplexer comprising:

first and second dielectric filters, wherein at least one of the first and second dielectric filters is the dielectric filter according to claim 13; and an input-output electrode connecting an antenna arranged between the first and second dielectric filters, the input-output electrode outputting an output signal from the first dielectric filter and inputting an input signal to the second dielectric filter.

27. The duplexer according to claim 26, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, and wherein an electrode formed along an area from the mounting surface toward the short-circuit face separately from the external conductor is electrically connected to the inner conductor on the internal surface of the excitation hole so as to have the input-output electrode for the connection of an antenna.

28. A dielectric duplexer comprising:

first and second dielectric filters, wherein the first dielectric filter is the dielectric filter according to claim 13; and an input-output electrode connecting an antenna arranged between the first and second dielectric filters, the input-output electrode outputting an output signal from the first dielectric filter and inputting an input signal to the second dielectric filter, wherein a through-hole is formed from an intermediate position on the open end face between the first and second dielectric filters toward a position opposing the short-circuit face, the through-hole being provided with an inner conductor formed on the internal surface so as to form an excitation hole by electrically connecting the inner conductor to an external conductor on the open end face, wherein an electrode formed along an area from the mounting surface toward the short-circuit face separately from the external conductor is electrically connected to the inner conductor on the internal surface of the excitation hole so as to have the input-output electrode for the connection of an antenna, and wherein only an open end-face electrode corresponding to a final stage resonator in a plurality of the open end-face electrodes of the second dielectric filter includes an electrode-protruding part protruding toward a central resonator hole of the plurality of resonator holes of the second dielectric filter from a vicinity of an edge perpendicular to an arranging direction of the plurality of resonator holes of the second dielectric filter, and the open end-face electrodes of the resonator holes positioned at both ends of the plurality of resonator holes of the second dielectric filter are configured to generate the first capacitance by opposing each other via the electrode-protruding part.

29. A communication apparatus comprising:

a high-frequency circuit; and the dielectric filter according to claim 1.

30. A communication apparatus comprising:

a high-frequency circuit; and the dielectric filter according to claim 5.

31. A communication apparatus comprising:

a high-frequency circuit; and the dielectric filter according to claim 9.

32. A communication apparatus comprising:

a high-frequency circuit; and the dielectric filter according to claim 13.

* * * * *